US006471541B2

(12) United States Patent
Kunishi et al.

(10) Patent No.: US 6,471,541 B2
(45) Date of Patent: Oct. 29, 2002

(54) ELECTRICAL CONNECTOR FOR FLAT CABLES

(75) Inventors: Shinsuke Kunishi, Hatano (JP); Yoshiyuki Mizuno, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/864,786

(22) Filed: May 24, 2001

(65) Prior Publication Data

US 2002/0045374 A1 Apr. 18, 2002

(30) Foreign Application Priority Data

Jun. 5, 2000 (JP) ..... 2000-167975

(51) Int. Cl.[7] ..... H01R 9/07
(52) U.S. Cl. ..... 439/495; 439/492
(58) Field of Search ..... 439/495, 492, 439/493, 494, 496, 497, 498, 499, 260, 326, 327, 328, 329

(56) References Cited

U.S. PATENT DOCUMENTS

| | | | | |
|---|---|---|---|---|
| 4,944,690 | A | 7/1990 | Imai | 439/492 |
| 5,173,058 | A | 12/1992 | Broeksteeg et al. | 439/267 |
| 5,458,506 | A | 10/1995 | Yamaguchi et al. | 439/495 |
| 5,580,272 | A | 12/1996 | Yamaguchi et al. | 439/495 |
| 5,639,260 | A | 6/1997 | McHugh | 439/495 |
| 5,695,359 | A | 12/1997 | Fujikura et al. | 439/495 |
| 5,695,360 | A | 12/1997 | Seto et al. | 439/495 |
| 5,738,545 | A | 4/1998 | Igarashi et al. | 439/607 |
| 5,785,549 | A | 7/1998 | Takayasu | 439/495 |
| 5,839,917 | A | 11/1998 | Takahashi et al. | 439/495 |
| 5,842,883 | A | 12/1998 | Igarashi et al. | 439/495 |
| 5,895,287 | A | 4/1999 | Seto et al. | 439/495 |
| 5,904,586 | A | 5/1999 | Takayasu | 439/260 |
| 5,056,572 | A | 5/2000 | Matsumoto et al. | 439/260 |
| 6,056,571 | A | 5/2000 | Noro | 439/260 |
| 6,099,346 | A | 8/2000 | Hashiguchi et al. | 439/495 |
| 6,206,723 | B1 * | 3/2001 | Kunishi | 439/495 |

FOREIGN PATENT DOCUMENTS

| | | | |
|---|---|---|---|
| JP | 2580074 | 6/1998 | H01R/23/68 |

* cited by examiner

*Primary Examiner*—P. Austin Bradley
*Assistant Examiner*—Alexander Gilman
(74) *Attorney, Agent, or Firm*—Stephen Z. Weiss

(57) ABSTRACT

An electrical connector is provided for a flat cable having an upper surface and a lower surface. The connector includes a dielectric housing having an opening for receiving an end of the flat cable in a cable-insertion slot. A plurality of first terminals are mounted in the housing and each has a generally U-shaped configuration defining a base leg and an upper leg. Both legs are fixed in the housing and define a mouth therebetween coincident with the opening in the housing for receiving the end of the flat cable. A flexible contact arm extends from a distal end of the base leg into the mouth and defines a first contact section. A plurality of second terminals are mounted in the housing and each includes a base fixed in the housing and a bifurcated arm flexibly connected to the base and extending toward the opening in the housing. The bifurcated arm includes an upper arm extension and a lower arm extension having a second contact section. An actuator is pivotally mounted on the housing for movement between an open position and a closed position and includes a pivot section engageable with pivot sections of the upper legs of the first terminals and a pressure section facing downwardly toward the cable-insertion slot. The actuator in its open position allows the flat cable to be inserted freely into the slot. The actuator in its closed position causes the pressure section thereof to engage the upper surface of the flat cable and bias the lower surface of the cable against the second contact sections of the second terminals, while the upper arm extensions of the second terminals engage the upper surface of the flat cable and bias the lower surface of the cable against the first contact sections of the first terminals.

6 Claims, 4 Drawing Sheets

ELECTRICAL CONNECTOR FOR FLAT CABLES

FIELD OF THE INVENTION

This invention generally relates to the art of electrical connectors and, particularly, to a connector for terminating a flat cable.

BACKGROUND OF THE INVENTION

A wide variety of electrical connectors have been designed for terminating flat cables or circuits, such as flat flexible cables, flexible printed circuits or the like. A typical connector for flat cables includes a dielectric housing molded of plastic material, for instance. The housing has an elongated slot for receiving an end of the flat cable which has been stripped to expose generally parallel, laterally spaced conductors. A plurality of terminals are mounted in the housing and are spaced laterally along the slot for engaging the laterally spaced conductors of the flat cable. An actuator often is movably mounted on the housing for movement between a first position whereat the flat cable is freely insertable into the slot and a second position whereat the actuator clamps the cable in the housing and biases the cable against the terminals.

Flat cable connectors of the prior art described above typically are either of the type that provides for low insertion forces on the cable when the actuator is in its open position or of the type that provides for zero insertion forces on the cable. Problems have been encountered with both types of connectors. With the low insertion force connectors, as the number of terminals increase, the insertion force increases and unacceptable forces resist the insertion and withdrawal of the cable into and out of the slot in the connector housing. With zero force connectors, the cable has a tendency to slip out of the slot in the housing during manipulation of the connector and closing of the actuator, resulting in unacceptable or defective connections between the cable conductors and the terminals. The present invention is directed to solving these problems by providing a flat cable connector having different types of terminals in the same connector, whereby the insertion forces on the cable can be adjusted if desired. In addition, the configurations of the terminals, themselves, are of new and improved designs.

SUMMARY OF THE INVENTION

An object, therefore, of the invention is to provide a new and improved electrical connector for terminating flat cables or circuits.

In the exemplary embodiment of the invention, the connector includes a dielectric housing having an opening for receiving an end of the flat cable in a cable-insertion slot. The cable has an upper surface and a lower surface. A plurality of first terminals are mounted in the housing, and each first terminal has a generally U-shaped configuration defining a base leg and an upper leg. Both legs are fixed in the housing and define a mouth therebetween coincident with the opening in the housing for receiving the end of the flat cable. A flexible contact arm extends from a distal end of the base leg near the opening in the housing and into the mouth to a free end of the arm which defines a first contact section facing upwardly into the cable-receiving slot. The upper leg has a pivot section near a distal end thereof, facing the base leg. A plurality of second terminals are mounted in the housing and each second terminal has a base fixed in the housing and a bifurcated arm flexibly connected to the base and extending toward the opening in the housing. The bifurcated arm includes an upper arm extension and a lower arm extension having a second contact section near a distal end thereof facing upwardly into the cable-insertion slot.

The connector includes an actuator pivotally mounted on the housing for movement between an open position and a closed position. The actuator has a pivot section engageable with the pivot section of the upper legs of the first terminals and a pressure section facing downwardly toward the cable-insertion slot. In its open position, the actuator allows the flat cable to be inserted into the slot between the pressure section of the actuator and upper legs of the first terminals and the first contact sections of the first terminals and second contact sections of the second terminals. In its closed position, the actuator causes the pressure section thereof to engage the upper surface of the flat cable and bias the lower surface of the flat cable against the second contact sections of the second terminals while the upper arm extensions of the second terminals engage the upper surface of the flat cable and bias the lower surface of the flat cable against the first contact sections of the first terminals.

As disclosed herein, the pivot sections of the first terminals are generally aligned across the slot with the second contact sections of the second terminals. The upper arm extensions of the second terminals are generally aligned across the slot with the first contact sections of the first terminals. The pressure section of the actuator is located immediately adjacent the pivot section thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE DRAWINGS

Figure 1:
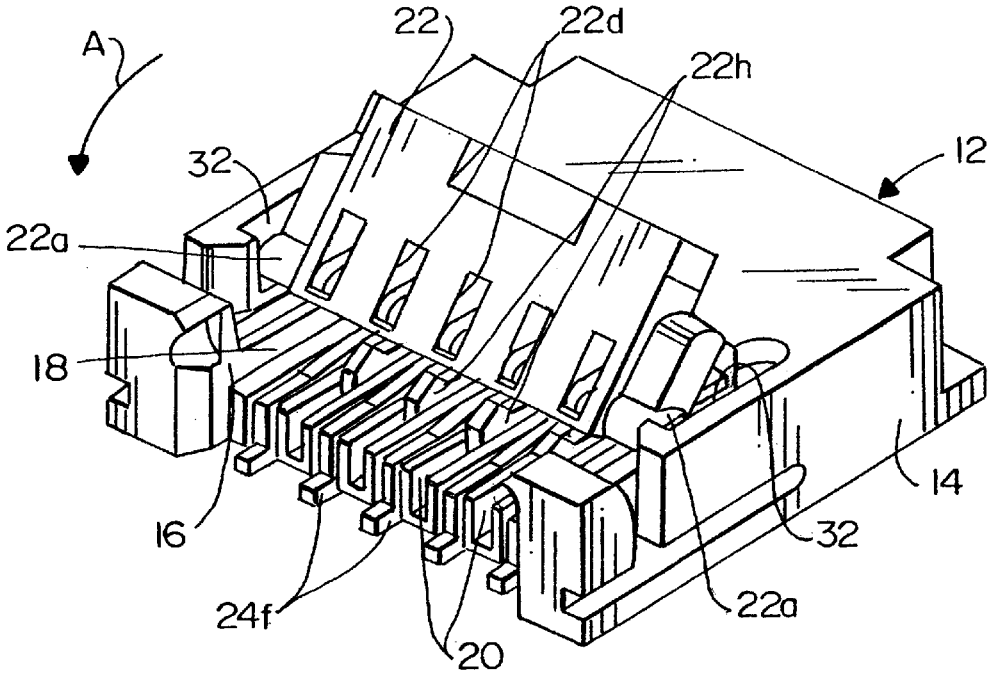
FIG. 1 is a perspective view of a flat cable connector according to the invention, with the actuator in its open position.
Figure 2:
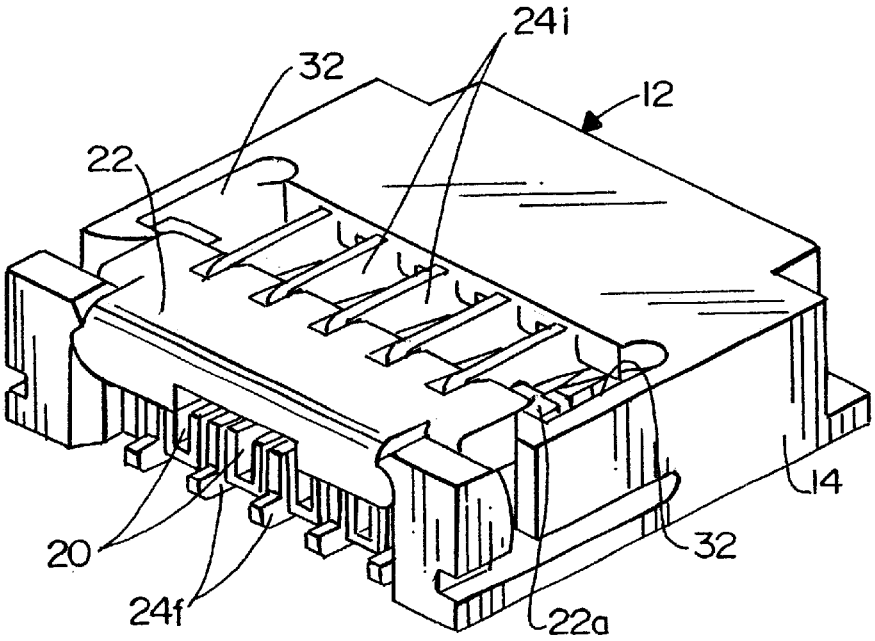
FIG. 2 is a perspective view similar to that of FIG. 1, with the actuator in its closed position.

Referring to the drawings in greater detail, and first to FIGS. 1 and 2, the invention is embodied in an electrical connector, generally designated 12, for a flat cable, a flexible circuit or the like. The connector includes a housing 14 which may be of molded plastic material or the like. The housing defines an opening 16 for receiving an end of the flat cable into a cable-insertion slot 18. The housing defines a plurality of terminal-receiving passages 20. An actuator 22 is pivotally mounted on housing 14 for pivotal movement in the direction of arrow "A" (FIG. 1) from an open position shown in FIG. 1 to a closed position shown in FIG. 2. In the open position of FIG. 1, the flat cable can be inserted into slot 18 through opening 16 in the housing. In the closed position of FIG. 2, the actuator biases the flat cable against contact sections of a plurality of terminals mounted in the housing, as described hereinafter.

At this point, it should be understood that the use of such terms as "upper", "lower", "top", "bottom" and the like herein and in the claims hereof are not intended to be limiting in any way, because connector 12 can be used in actual practice, in omni-directional orientations. Such terms are used herein to provide a clear and concise understanding of the invention as the connector is oriented in the drawings.

Figure 3:
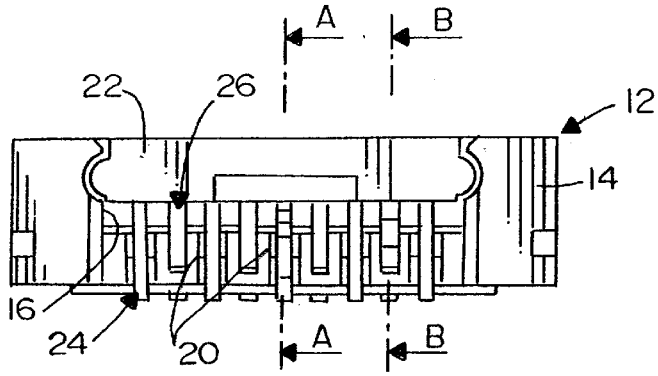
FIG. 3 is a front elevational view of the connector with the actuator in its closed position.

Referring to FIG. 3, a plurality of first terminals, generally designated 24, are mounted in passages 20 in housing 14 in an alternating array along slot 18 with a plurality of second terminals, generally designated 26. The terminals may be stamped from conductive sheet metal material. Terminals 24 allow the flat cable to be inserted into slot 18 with minimal or least-resistant insertion forces and the terminals, therefore, can be described as "LIF" terminals 24. Terminals 26 allow the flat cable to inserted into the slot with zero insertion forces and, therefore, terminals 26 can be referred to as "ZIF" terminals.

Figure 4:
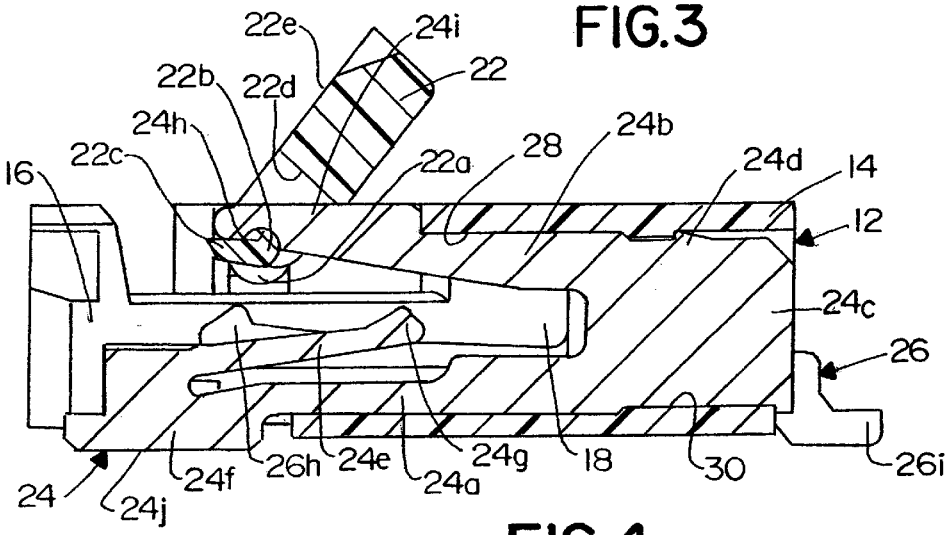
FIG. 4 is an enlarged section taken generally along line A—A in FIG. 3, but with the actuator in its open position.

Referring to FIG. 4, each first or LIF terminal 24 has a generally U-shaped configuration defining a base leg 24*a* and an upper leg 24*b*. The legs project forwardly toward opening 16 in housing 14 from a body portion 24*c* of the terminal. The body portion includes retaining teeth 24*d*, and the body portion, along with base leg 24*a* and upper leg 24*b* are fixed within the housing between upper and lower interior walls 28 and 30, respectively. A flexible contact arm 24*e* extends from a distal end 24*f* of base leg 24*a* near opening 16 in the housing to a free end of the arm which defines a first contact section 24*g*. The contact section faces upwardly into cable-insertion slot 18. In essence, base leg 24*a* and upper leg 24*b* define a mouth therebetween which is coincident with opening 16 in housing 14 for receiving the end of the flat cable. A pivot section or recess 24*h* is defined on the bottom side of upper leg 24*b* near the distal end 24*i* thereof. Finally, distal end 24*f* of base leg 24*a* defines a bottom surface 24*j* for engaging an appropriate circuit pad on a printed circuit board.

Figure 5:
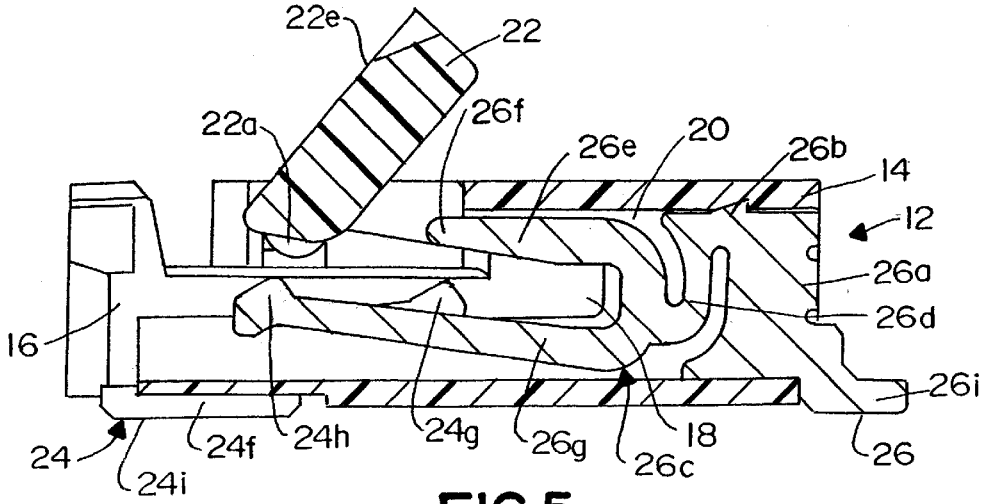
FIG. 5 is an enlarged section taken generally along line B—B of FIG. 3, but with the actuator in its open position.

Referring to FIG. 5, each second or ZIF terminal 26 includes a base 26*a* fixed within one of the terminal-receiving passages 20 in housing 14. The base includes at least one retaining tooth 26*b* for skiving into the plastic material of the housing. A bifurcated arm, generally designated 26*c* is flexibly joined to base 26*a* by a flexible web 26*d*. The bifurcated arm extends forwardly into slot 18 toward opening 16 in the housing. The bifurcated arm defines a upper arm extension 26*e* having a distal end 26*f* and a lower arm extension 26*g* having a second contact section 26*h* at the distal end thereof. A tail 26*i* extends from base 26*a* out of the housing for engaging an appropriate circuit pad on the printed circuit board.

Referring to FIGS. 1 and 2, it can be seen that actuator 22 has a pair of pivot trunions 22*a* projecting from opposite ends thereof and seated in recessed areas of housing 14. Referring to FIG. 4, it can be seen that actuator 22 has a pivot section 22*b* which is seated within pivot sections 24*h* at the distal ends of upper legs 24*b* of first terminals 24. Thus, the actuator is captured for pivotal movement relative to the housing between its open position (FIG. 1) and its closed position (FIG. 2).

Referring FIG. 4, actuator 22 further includes a pressure section 22*c* which faces downwardly toward cable-receiving slot 18 immediately adjacent pivot section 22*b* of the actuator. The actuator is a generally flat plate which may be fabricated of dielectric material such as plastic or the like. The actuator has a plurality of slots 22*d* for accommodating distal ends 24*i* of upper legs 24*b* of first terminals 24. Finally, the actuator has a flat face 22*e* which faces the flat cable when the actuator is in its closed position.

From the foregoing, it can be seen in FIG. 4 that pressure section 22*c* of actuator 22 is generally aligned across cable-insertion slot 18 with second contact sections 26*h* of second terminals 26. It can be seen in FIG. 5 that first contact sections 24*g* of first terminals 24 are aligned across cable-insertion slot 18 with distal ends 26*f* of upper arm extensions 26*e* of second terminals 26.

Figure 6:
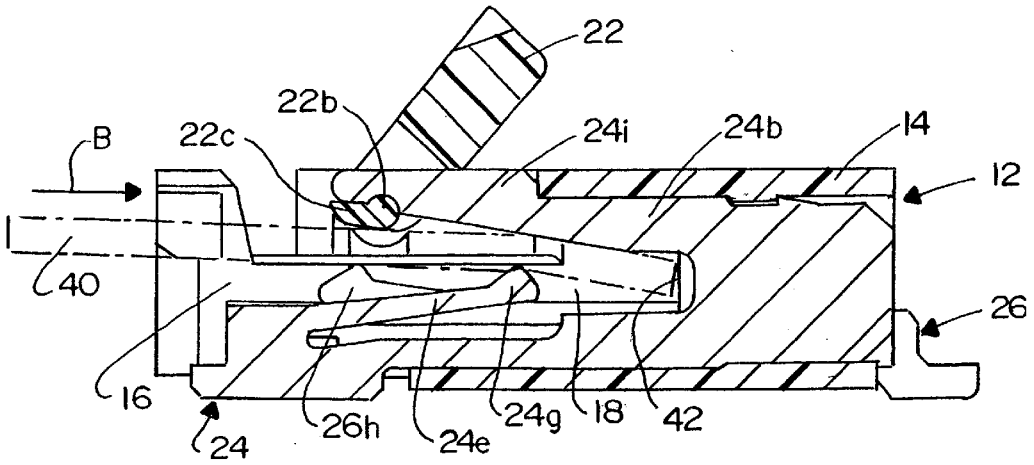
FIG. 6 is a view similar to that of FIG. 4, but showing a flat cable, in phantom, inserted into the connector.
Figure 7:
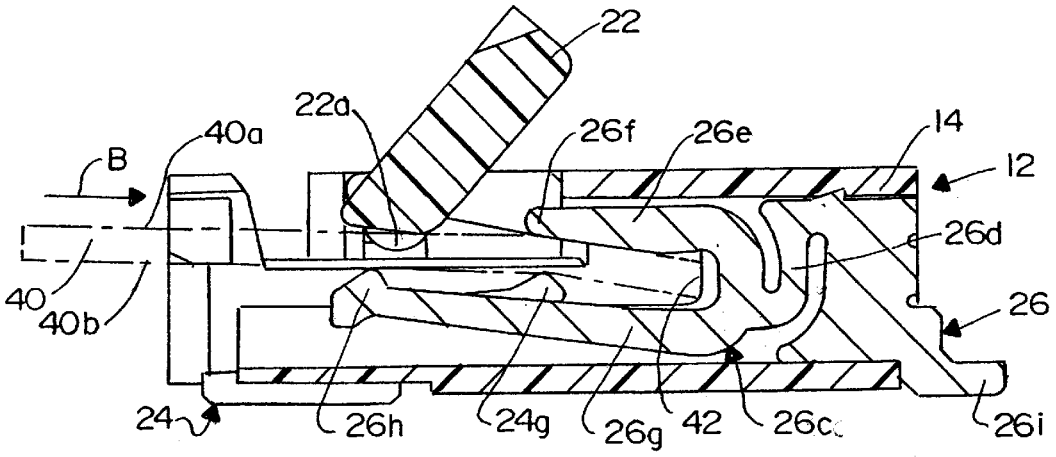
FIG. 7 is a view similar to that of FIG. 5, but showing the flat cable, in phantom, inserted into the connector.

The operation of connector 12 now will be described. Referring first to FIGS. 6 and 7, a flat cable 40 is inserted in the direction of arrow "B" through mouth 16 and into slot 18 of housing 14. It can be seen that actuator 22 is pivoted upwardly to its open position to allow for insertion of the cable. As seen in FIG. 6, the end of the flat cable first will be inserted between second contact sections 26*h* of second terminals 26 and pressure section 22*c* of actuator 22. As seen in FIG. 7, the end of the cable then will be inserted past first contact sections 24*g* of first terminals 24 and distal ends 26*f* of upper arm extensions 26*e* of second terminals 26. The end of the flat cable eventually bottoms out against an interior wall 42 of housing 14 at the inner end of cable-insertion slot 18.

Figure 8:
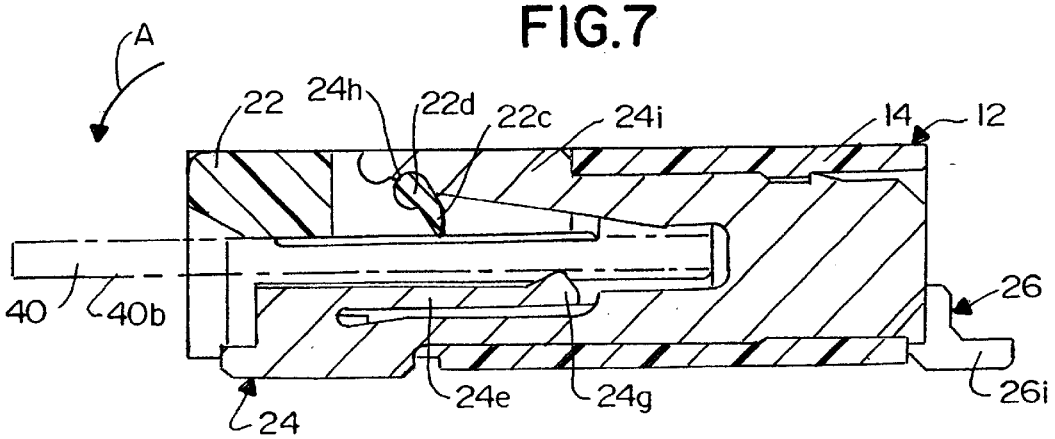
FIG. 8 is a view similar to that of FIG. 6, but with the actuator in its closed position.
Figure 9:
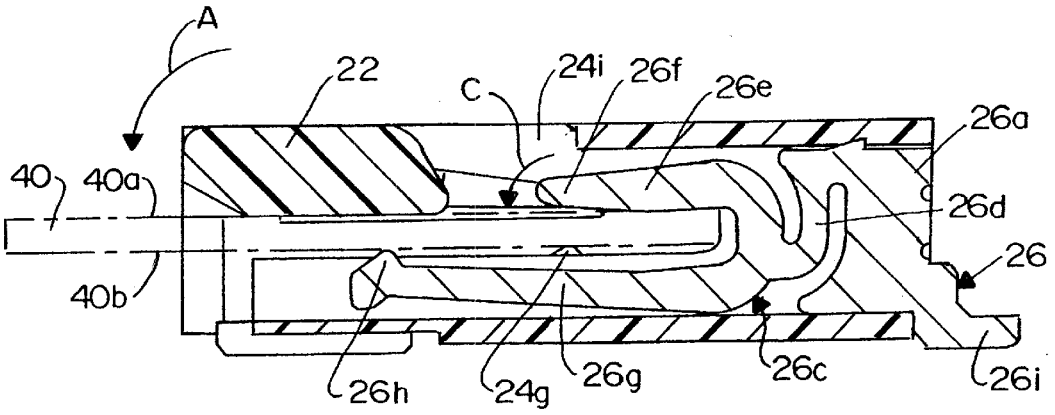
FIG. 9 is a view similar to that of FIG. 7, but with the actuator in its closed position.

After the flat cable is fully inserted into slot 18 in the connector housing, actuator 22 is rotated in the direction of arrow "A" to its closed position shown in FIGS. 8 and 9. During closing, pressure section 22*c* of the actuator engages an upper surface 40*a* of flat cable 40 and biases a lower surface 40*b* of the flat cable downwardly against the contact sections of the terminals. Specifically, as seen in FIG. 9, the actuator biases the flat cable downwardly against second contact sections 26*h* of second terminals 26 which, effectively, causes bifurcated arms 26*c* to rotate in the direction of arrow "C" (FIG. 9) relative to fixed bases 26*a* of the second terminals due to the flexibility of webs 26*d* of the terminals. This causes distal ends 26*f* of upper arm extensions 26*e* of the bifurcated arms to engage top surface 40*a* of the flat cable and bias bottom surface 40*b* of the flat cable against first contact sections 24*g* of first terminals 24.

Figure 10:
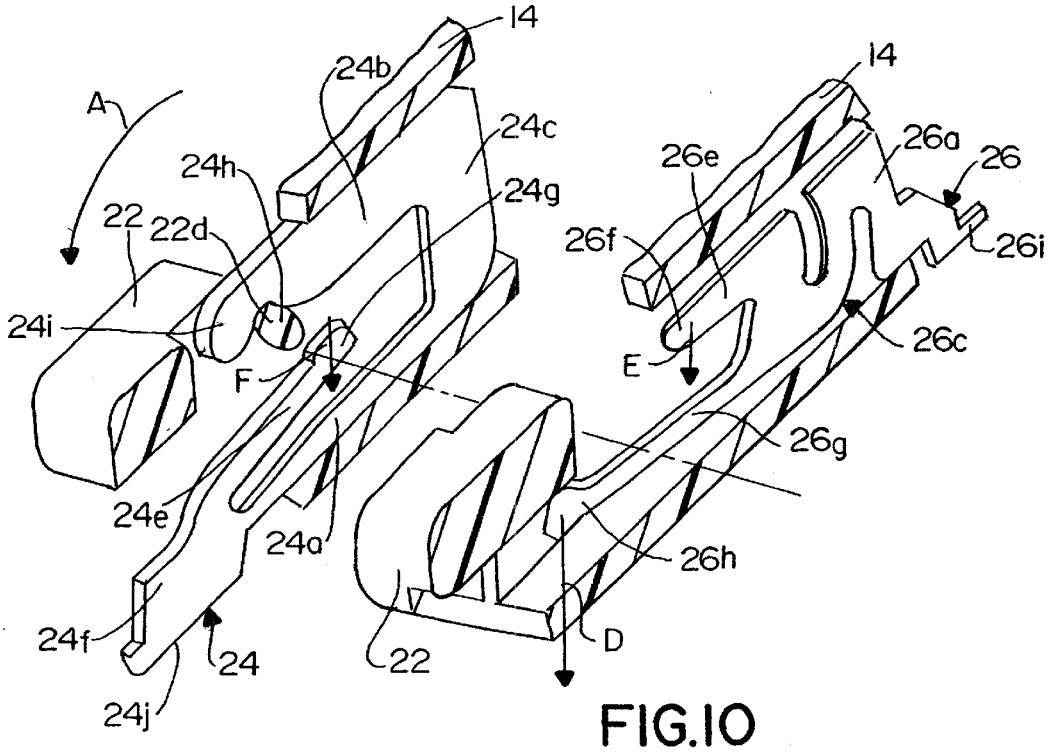
FIG. 10 is a fragmented and cut-away perspective view through various areas of the connector housing to show the two different terminals of the connector.

The above action is somewhat schematically illustrated in FIG. 10 which shows actuator 22 having been pivoted to its closed position in the direction of arrow "A". The actuator effectively biases the flat cable against second contact sections 26*h* of second terminals 26 in the direction of arrow "D". This causes bifurcated arms 26*c* of the second terminals to pivot so that upper arm extensions 26*e* apply a downward force in the direction of arrow "E" against upper surface 40*a* of flat cable 40 to bias lower surface 40*b* of the flat cable against first contact sections 24*g* of first terminals 24 in the direction of arrow "F".

In actual practice, flat cable 40 will have a plurality of conductors extending lengthwise thereof, and the insulation of the cable will be stripped to expose the conductors on bottom surface 40*b* of the cable. Contact sections 24*g* and 26*h* of first and second terminals 24 and 26, respectively, will alternatingly engage the exposed conductors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for a flat cable having an upper surface and a lower surface, comprising:

a dielectric housing having an opening for receiving an end of the flat cable in a cable-insertion slot;

a plurality of first terminals mounted in the housing, each first terminal having a generally U-shaped configuration defining a base leg and an upper leg, both legs being fixed in the housing and defining a mouth therebetween coincident with the opening in the housing for receiving the end of the flat cable, a flexible contact arm extending from a distal end of the base leg near the opening in the housing and into said mouth to a free end of the arm which defines a first contact section facing upwardly into the cable-insertion slot, and the upper leg having a pivot section near a distal end thereof facing the base leg;

a plurality of second terminals mounted in the housing, each second terminal having a base fixed in the housing and a bifurcated arm flexibly connected to the base and extending toward the opening in the housing, the bifurcated arm including an upper arm extension and a lower arm extension having a second contact section near a distal end thereof facing upwardly into the cable-insertion slot; and an actuator pivotally mounted on the housing for movement between an open position and a closed position and having a pivot section engageable with the pivot sections of the upper legs of the first terminals and a pressure section facing downwardly toward the cable-insertion slot, said actuator in its open position allowing the flat cable to be inserted into said slot between the pressure section of the actuator and upper legs of the first terminals and the first contact sections of the first terminals and second contact sections of the second terminals, and said actuator in its closed position causing the pressure section thereof to engage the upper surface of the flat cable and bias the lower surface of the flat cable against the second contact sections of the second terminals while the upper arm extensions of the second terminals engage the upper surface of the flat cable and bias the lower surface of the flat cable against the first contact sections of the first terminals.

2. The electrical connector of claim 1 wherein said pivot sections of the first terminals are generally aligned across said slot with the second contact sections of the second terminals.

3. The electrical connector of claim 2 wherein said pressure section of the actuator is located immediately adjacent the pivot section thereof.

4. The electrical connector of claim 1 wherein said upper arm extensions of the second terminals are generally aligned across said slot with the first contact sections of the first terminals.

5. The electrical connector of claim 4 wherein said pivot sections of the first terminals are generally aligned across said slot with the second contact sections of the second terminals.

6. The electrical connector of claim 5 wherein said pressure section of the actuator is located immediately adjacent the pivot section thereof.

* * * * *